United States Patent [19]

Sansevero

[11] Patent Number: 4,949,832

[45] Date of Patent: Aug. 21, 1990

[54] CURVED ESCALATOR WITH VERTICAL PLANAR STEP RISERS AND CONSTANT HORIZONTAL VELOCITY

[75] Inventor: Frank M. Sansevero, West Hartford, Conn.

[73] Assignee: Otis Elevator Company, Farmington, Conn.

[21] Appl. No.: 422,265

[22] Filed: Oct. 16, 1989

[51] Int. Cl.[5] ..... B66B 21/02

[52] U.S. Cl. ..... 198/328; 198/778; 198/845

[58] Field of Search ..... 198/328, 333, 326, 778, 198/831, 845

[56] References Cited

U.S. PATENT DOCUMENTS

| | | | |
|---|---|---|---|
| 617,778 | 1/1899 | Seeberger . | |
| 617,779 | 1/1899 | Seeberger . | |
| 685,019 | 10/1901 | Venn . | |
| 723,325 | 3/1903 | Souder | 198/328 X |
| 727,720 | 5/1903 | Venn . | |
| 782,009 | 2/1905 | Dodge . | |
| 967,710 | 8/1910 | Bennett . | |
| 984,495 | 2/1911 | Seeberger . | |
| 984,858 | 2/1911 | Seeberger . | |
| 999,885 | 8/1911 | Seeberger . | |
| 1,023,443 | 4/1912 | Seeberger . | |
| 2,695,094 | 11/1954 | Riley . | |
| 2,823,785 | 2/1958 | Hefti . | |
| 3,395,648 | 8/1968 | Karr et al. | 198/328 X |
| 3,878,931 | 4/1975 | Luna . | |
| 4,411,352 | 10/1983 | Kettle | 198/328 |
| 4,434,884 | 3/1984 | Kettle | 198/328 |
| 4,662,502 | 5/1987 | Nakatami | 198/328 |
| 4,681,206 | 7/1987 | Sugita | 198/328 |
| 4,726,460 | 2/1988 | Otomo | 198/328 |
| 4,730,717 | 3/1988 | Sugita | 198/328 |
| 4,739,870 | 4/1988 | Saito | 198/328 |
| 4,746,000 | 5/1988 | Nakatami et al. | 198/328 |
| 4,775,043 | 10/1988 | Tomidokoro | 198/328 |
| 4,883,160 | 11/1989 | Sanseruo et al. | 198/328 |
| 4,895,239 | 1/1990 | Johnson et al. | 198/328 |

FOREIGN PATENT DOCUMENTS

| | | |
|---|---|---|
| 3441845A | 6/1985 | Fed. Rep. of Germany . |
| 48-25559 | 7/1973 | Japan . |
| 58-220007 | 12/1983 | Japan . |
| 292641 | 6/1928 | United Kingdom . |

*Primary Examiner*—Joseph E. Valenza
*Assistant Examiner*—D. Glenn Dayoan
*Attorney, Agent, or Firm*—William W. Jones

[57] ABSTRACT

The escalator has steps with vertical planar cleated risers which mesh with cleated trailing edges of the adjacent step. The step chains are selectively kinked and unkinked to provide for a constant spacing of adjacent step axles throughout the path of travel of the escalator. The steps thus display a constant horizontal velocity. The escalator can be adapted to follow a fixed center constant radius in plan helical path of travel.

7 Claims, 4 Drawing Sheets

CURVED ESCALATOR WITH VERTICAL PLANAR STEP RISERS AND CONSTANT HORIZONTAL VELOCITY

TECHNICAL FIELD

This invention relates to a curved escalator construction, and more particularly to a curved escalator having a path of travel defined by a fixed center, constant radius arc when viewed in plan. Background Art Escalators which follow a curved path of travel from entry landing to exit landing are generally known in the prior art. There are two general approaches which have been taken in the prior art to designing an operable curved escalator. One approach involves the use of a path of travel which, in plan, is defined by an arc having varying radii of curvature and emanating from a shifting center. The other approach involves the use of a path of travel which, in plan, is defined by an arc of constant radius struck from a fixed center.

Patent publications which relate to the aforesaid first approach include: Japanese Pat. Publication 48-25559 of July, 1973; German Pat. Publication 3,441,845, Jun. 13, 1985; U.S. Pat. No. 4,662,502, Nakatani, et al., granted May 5, 1987; and U.S. Pat. No. 4,746,000, Nakatani, et al., granted May 24, 1988.

Patent publications which relate to the aforesaid second approach include: U.S. Pat. Nos. 685,019, Oct. 22, 1901; 723,325, Mar. 24, 1903, 727,720, May 12, 1903; 782,009, Feb. 7, 1905; 967,710, Aug. 16, 1910; 2,695,094, Nov. 23, 1954; 2,823,785, Feb. 18, 1958; 3,878,931, Apr. 22, 1975; 4,726,460, Feb. 23, 1988; 4,730,717, Mar. 15, 1988; 4,739,870, Apr. 26, 1988; British Pat. No. 292,641, Jun. 22, 1928; and Japanese Pat. Disclosure No. 58-220077, 1983.

Japanese Pat. Disclosure No. 58-220077, dated Dec. 21, 1983 discloses a curved escalator which has a constant radius, fixed center arcuate path of travel when viewed in plan. When the treads of the escalator move from the horizontal landing to the constant slope intermediate zone, they are properly repositioned by accelerating and decelerating their inside edges in the transition zones adjacent the landings. The differential movement of the inside tread edges is accomplished with pivoting links which interconnect the step axles of adjacent steps and which are joined at pivot points provided with rollers that traverse a track. The step axles also have rollers at their inside ends which travel over another track vertically spaced from the link roller track. The position of the inside edges of the steps is varied in the transition zone by varying the vertical distance between the inside step axle roller track and the link roller track beneath it. The links lengthen in the constant slope portion of the escalator and shorten in the horizontal landing and turn around zones. The steps are engaged by driving chains which connect to the step axles only in the constant slope zone where the position of the steps relative to each other remains constant. The drive chains do not contact the step axles in the transition, landing, or turnaround zones. Varying the position of the inside edge of the steps requires that the connecting links be shortened in the horizontal and turn around zones of the escalator, and the use of two separate tracks for the inside step axle roller and for the adjustment link rollers, requires that the adjustment links will always be skew throughout the entire path of travel of the escalator. The use of two separate axle roller and link roller tracks also requires that the drive housing and tread reverse sprockets be vertically elongated.

Charles D Seeberger was a turn-of-the-century inventor who obtained U.S. Pat. Nos. 617,778, granted Jan. 17, 1899; 617,779, granted Jan. 17, 1899; 984,495, granted Feb. 14, 1911; 984,858, granted Feb. 21, 1911; and 999,885, granted Aug. 8, 1911, which all relate to curved escalators. The 617,779 patent discusses the need to shorten and lengthen step chains in a curved escalator having a path of travel which has portions with different radii. The step chains are formed with segments which are threadedly connected to each other. The segments are rotated by a pinion mechanism to unscrew, or tighten the threaded connections whereby the chain is lengthened or shortened when necessary. The 984,495 patent states that a curved escalator with a fixed radius, constant center cannot have both ends of adjacent step axles connected to each other by links of fixed length. A scissor connection is then made between succeeding axles, and a slight adjustment of this connection is made when the steps move from the curved horizontal track section to the inclined curved section of the track. The adjustment is described at Page 3, line 119 to Page 4, line 28 of the patent. The 999,885 patent describes a curved escalator having its steps connected together at their inner and outer edges, with the outer edge connection being of constant length, and the inner edge connection being variable by reason of adjustable links.

Disclosure of the Invention

This invention relates to a step chain, step and track, assembly for use in a curved or helical escalator of the type having a fixed center, constant radius arcuate path of travel when viewed in plan. The step chain and track are operable to impart a constant plan view angular velocity to the inner and outer step chains whereby the steps will not undergo any change in horizontal velocity as they traverse the path of travel of the escalator. The only acceleration that the steps will experience is vertical acceleration (and deceleration). The step risers thus are vertical planar cleated surfaces on the steps. In the escalator of this invention, the treads of successive steps are coplanar at the entrance and exit landings. In the medial constant slope zone, the step treads are vertically offset from each other a constant distance. In the transition zones between the landings and the constant slope zone, the steps will move straight up or down from the offset to the coplanar positions, and reverse. There is no twisting or overriding of the steps in the escalator of this invention.

The constant plan view angular velocity of the steps throughout the path of travel of the escalator is accomplished by maintaining a constant horizontal distance between adjacent step axles when the steps are viewed in plan. The constant distance between adjacent step axles is maintained by selectively kinking and straightening the inside and outside step chains as the steps move along the path of travel of the escalator. When the steps are in the constant slope intermediate zone of the escalator, both inside and outside step chains will be rectilinear, or straight, so as to be substantially parallel, when viewed in elevation, with the tracks over which the steps move. When the steps are in the horizontal landing zones, the step chains will be kinked. Movement of the steps through the entrance and exit transition zones is accompanied by a controlled kinking or straightening of the step chains so that the chains smoothly change from one condition to the other and back. This controlled movement of the step chains is the result of inherent tension on the chains plus the provision of auxiliary chain roller tracks which guide auxiliary chain rollers along paths of movement that cause the chain to kink or straighten.

It is therefore an object of this invention to provide an escalator having steps which do not undergo any step tread horizontal acceleration or deceleration as the steps move along the path of travel of the escalator.

It is a further object of this invention to provide an escalator of the character described wherein the steps have vertical planar risers on them.

It is an additional object of this invention to provide an escalator of the character described wherein the steps move along a helical path of travel.

It is another object of this invention to provide an escalator of the character described wherein the path of travel of the escalator steps has a fixed center and a constant radius when viewed in plan.

These and other objects and advantages of the invention will be readily appreciated by one skilled in the art from the following detailed description of a preferred embodiment of the invention when taken in conjunction with the accompanying drawings, in which:

BEST MODE FOR CARRYING OUT THE INVENTION

Figure 2:
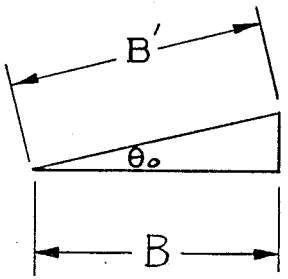
FIG. 2 is a diagram showing the manner of calculating the distance traveled in plan in an ascending or descending portion of the escalator.
Figure 1:
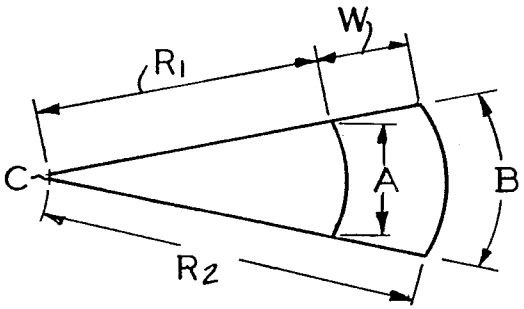
FIG. 1 is a diagrammatic view in plan of the path of travel taken by the steps in the escalator of this invention.

Referring to the drawings, FIG. 1 shows in plan a segment of the path of travel of a helical escalator formed in accordance with the invention. The path of travel of the escalator as viewed in plan is a circle having a fixed center C. The inside step chain moves a distance A projected onto a horizontal plane about a radius $R_1$, and the outside step chain moves a distance B projected onto the horizontal plane about a radius $R_2$. The distance between the step chains is W. As seen in FIG. 2, the distance B equals $B^1/\cos\theta_0$ where $\theta_0$ is the angle of inclination of the path of travel of the escalator at any point thereon where $B^1$ is the actual length of track traversed. The distance A can likewise be calculated.

Figure 3:
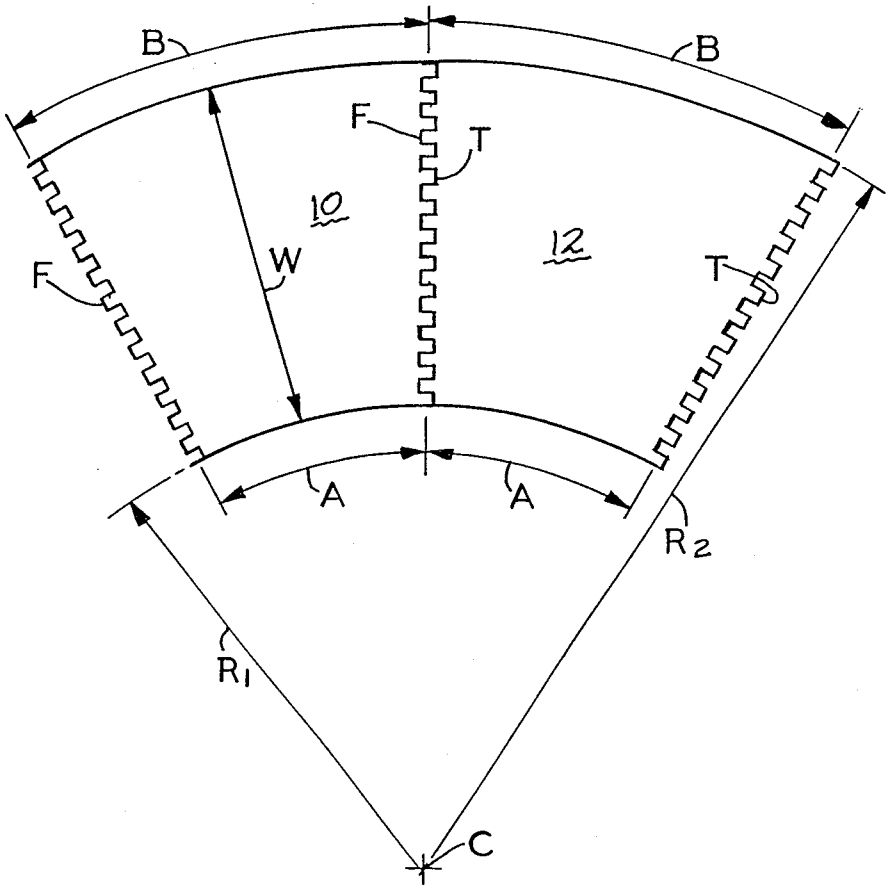
FIG. 3 is a plan view of a pair of adjacent steps and step treads on the escalator.

Referring to FIG. 3 there is shown in plan view two successive steps 10 and 12 on the escalator. The steps 10 and 12 have risers F and trailing edges T with meshing cleats formed thereon. Assuming for purposes of explanation that the step chains underlie the inner and outer edges of the steps 10 and 12, then the outer edges will have an arc length B and the inner edges will have an arc length A. Likewise, assuming that the step axle underlies the trailing edges T of the steps 10 and 12, then the distance between the outer ends of adjacent step axles will be B and the distance between the inner ends of adjacent step axle will be A.

Figure 4:
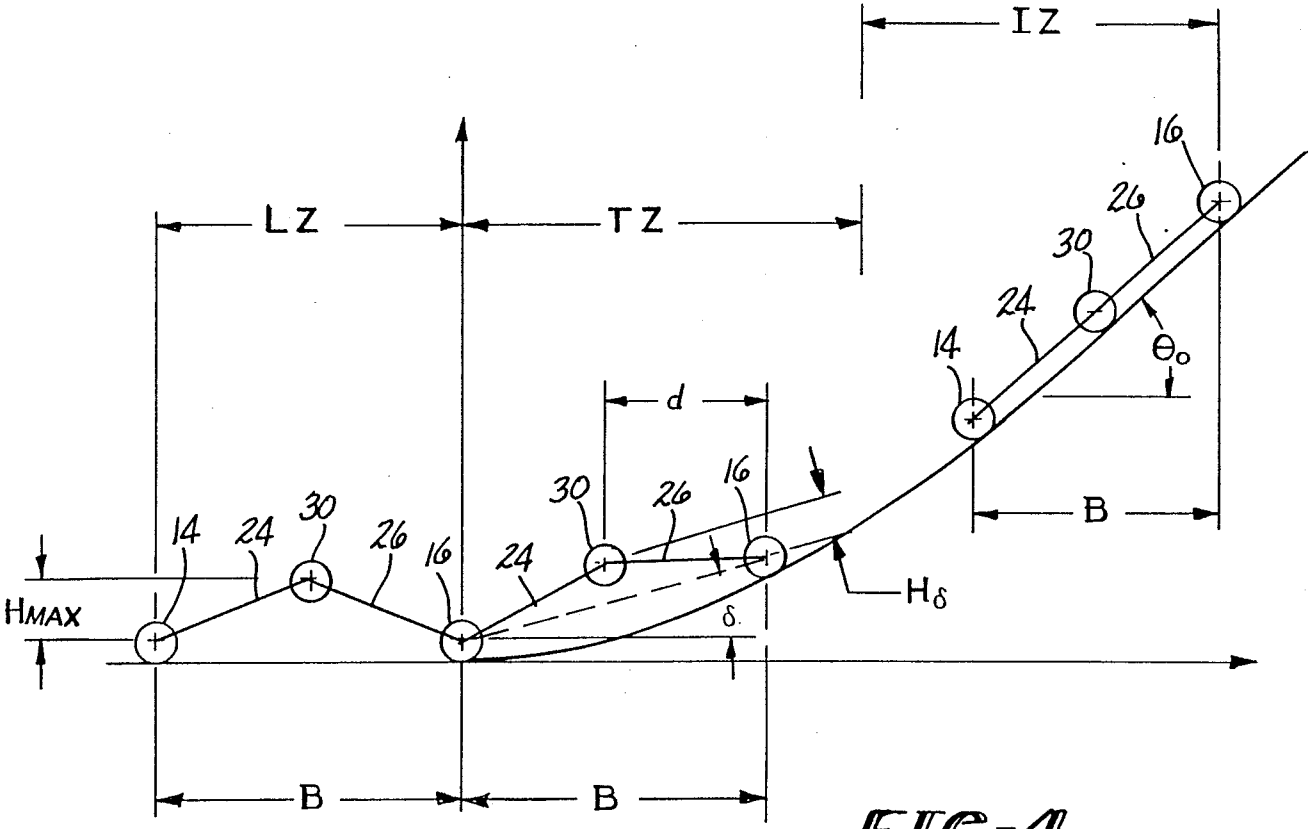
FIG. 4 is a diagram showing how the degree of chain kinking needed to produce constant horizontal velocity of the steps is calculated.

The step chains used in the escalator of this invention are constructed so as to maintain constant the arc distances A and B between adjacent step axles, as viewed in plan. Thus, no matter where the steps are along the path of travel of the escalator, the plan view arc distance between adjacent step axles is always the same. The horizontal component of the angular velocity of the steps is thus constant, whereby the steps do not accelerate or decelerate horizontally along the path of travel of the escalator. The only acceleration that the steps undergo is vertical acceleration. The step risers F are thus planar and perpendicular to the step treads. This is in contrast with a conventional escalator which has curvilinear step risers. The constant distances between adjacent step axles is maintained by selectively kinking and straightening both of the step chains. FIG. 4 illustrates diagrammatically how the step chains are kinked so as to maintain the distance B constant. The adjacent step axles are denoted by the numerals 14 and 16. The axles 14 and 16 are connected by links 24 and 26 hinged at joint 30. In the horizontal landing zone LZ the links 24 and 26 are angularly offset, or kinked, so that the axis of the joint 30 is upwardly offset from the axes of the step axles 14 and 16 by a distance $H_{max}$. The distance $H_{max}$ plus the length d of the links 24 and 26 establishes the arc length B which separates the axles 14 and 16. In order for the steps to have a constant angular velocity, the arc length B must be kept constant throughout the landing zone LZ, the transition zone TZ, and the inclined zone IZ. In the inclined zone IZ, the constant angle of incline is denoted by $\theta_0$, and in the transition zone TZ the varying angle of incline is denoted by $\delta$. In order to ensure that B stays constant, the distance $H_\delta$ must be controllably changed in the transition zone TZ. The formula governing this change is:

$$H_\delta = \sqrt{d^2 - \left(\frac{B}{2\cos\delta}\right)^2}$$

for the outer step chain; and $$H'_\delta = \sqrt{d'^2 - \left(\frac{A}{2\cos\delta'}\right)^2}$$

for the inner step chain, where $H_{67}$ and $H'_{67}$ is the distance between the axes of the respective outer and inner joint 30 and the step axles 14 and 16 measured perpendicular to a line connecting the step axle axes, as shown in FIG. 4. When $H_\delta$ is thus controlled, the distance B will remain constant. The step chains thus move from a kinked condition in the landing zones LZ to a rectilinear (in elevation) condition in the constant slope inclined zone IZ.

Figure 5:
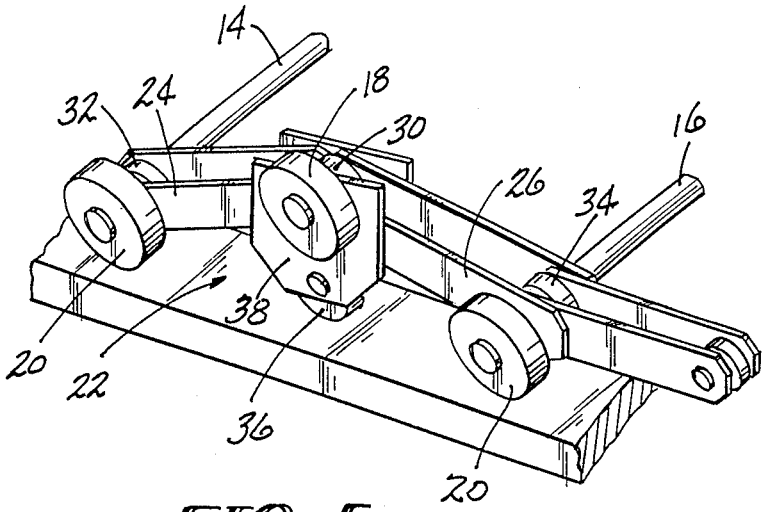
FIG. 5 is a perspective view of a segment of a step chain interconnecting adjacent step axles on the escalator in a horizontal landing zone.
Figure 6:
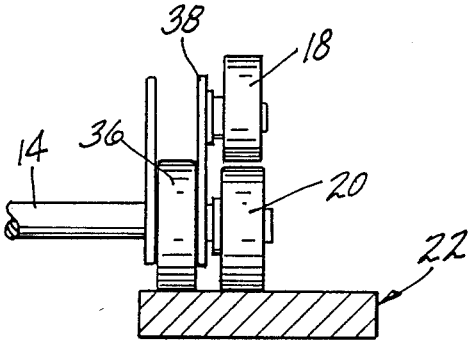
FIG. 6 is a fragmented elevational view looking down the chain showing the relationship of the various rollers mounted on the chain.

Referring to FIGS. 5 and 6 a preferred embodiment of a step chain and track structure operable to perform the necessary maintenance of step velocity is shown. The assembly is shown as it appears on the horizontal landings where $H_{max}$ is maintained. The step axles 14 and 16 have rollers 20 mounted thereon which roll over a track denoted generally by the numeral 22. The links 24 and 26 are pivoted to the step axles 14 and 16 at joints 32 and 34 respectively, and to each other at joint 30. The joint 30 is mounted on a bracket 38 which carries a lower roller 36 which rolls on the track 22. An upper roller 18 is also mounted on the bracket 38 at the joint 30. As seen in FIG. 6, the rollers 20 and 18 are aligned along the length of the track 22, and the roller 36 is transversely offset on the track 22 from the rollers 18 and 20. Thus the rollers 18, 20 and 36 move over the track 22 along adjacent laterally offset paths of travel.

Figure 8:
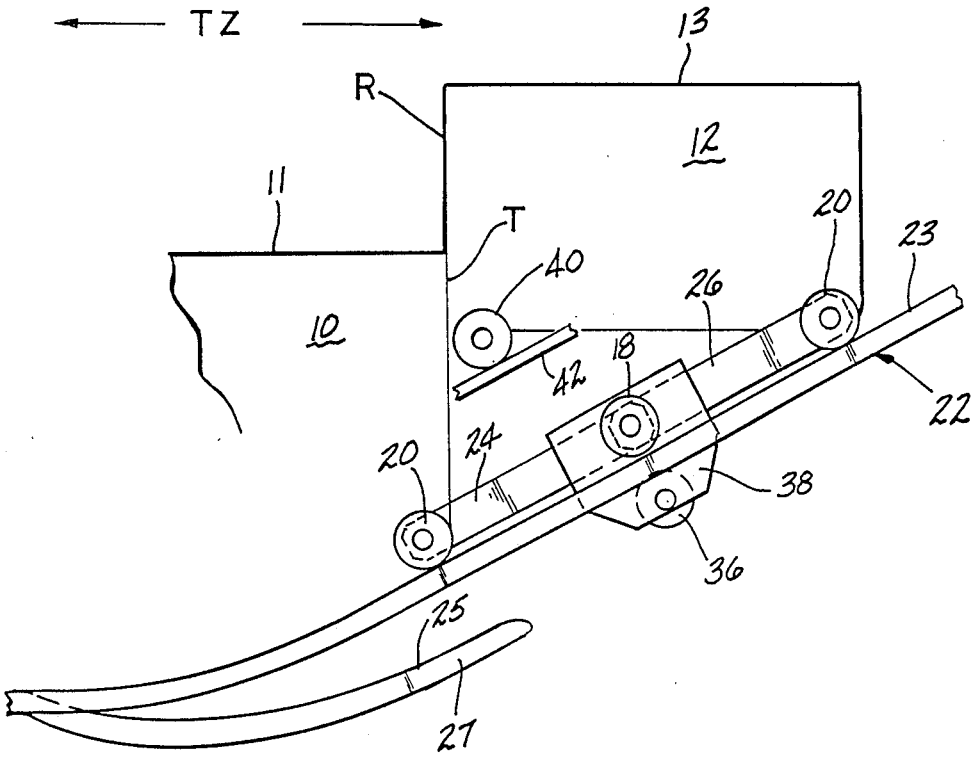
FIG. 8 is a side elevational view similar to FIG. 7 but showing the chain in the constant slope zone of the escalator.
Figure 7:
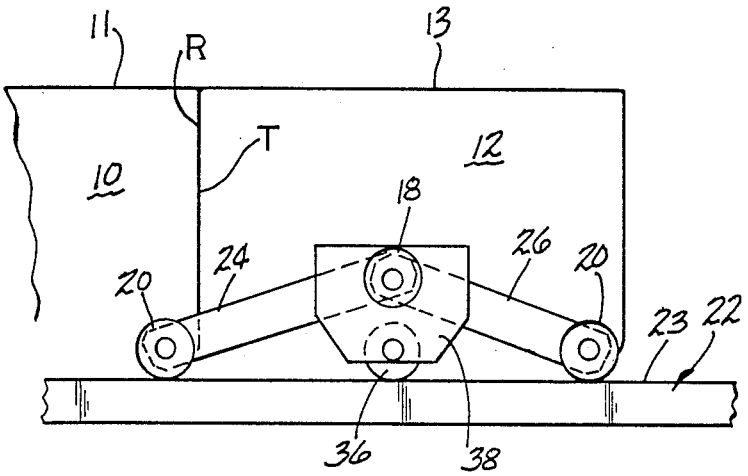
FIG. 7 is a side elevational view of the chain in the horizontal landing zones of the escalator.

Referring now to FIGS. 7 and 8, the steps 10, 12 and the step chain are shown in the landing zone in FIG. 7 and in the constant slope incline zone in FIG. 8. In the transition zone TZ, as shown in FIG. 8, the track 22 bifurcates with the path of travel of the roller 36 being provided by a branch track 27 which is adjacent to the main track 22. The roller 36 rolls along the top surface 25 of the branch track 27 which gradually falls away from the main track 22. This lowers the bracket 38 until the upper roller 18 contacts the top surface 23 of the main track 22. At that point the steps 10 and 12 are in the incline zone and the links 24 and 26 are rectilinear. The step 12 has risen above the step 10 while the step trailer roller 40 rolls along a separate track 42. It will be noted that if the escalator is moving to the left in FIG. 8, the branch track 27 will pick up the lower bracket roller 36 and lift it until it rides on the top 23 of the main track 22. This, of course, lifts the upper bracket roller 18 off of the track 22.

It will be readily appreciated that the escalator of this invention when configured to traverse a helical path, provides for greatly simplified construction. For example, the step risers are planar vertical components of the step and do not have the complex compound curvature of the prior art helical escalator. Very close tolerances are achievable for interfitting parts such as adjacent steps, and step and skirt guards due to the constant plan radius used in the escalator. The constant angular velocity of the steps eliminates the sensation of falling forward or backward which a passenger may experience in the prior art escalator. While the invention has been disclosed in the helical configuration, it is also applicable to a conventional escalator.

Since many changes and variations of the disclosed embodiment of the invention may be made without departing from the inventive concept, it is not intended to limit the invention otherwise than is required by the appended claims.

What is claimed is:

1. An escalator comprising a plurality of serially disposed steps; each of said steps having a vertical planar cleated riser part, a cleated trailing edge part and a step axle; the cleats in each riser part of each step meshing with the cleats in the trailing edge part of an adjacent step; and means for moving said steps along a passenger transporting path of travel which includes a pair of landing zones, a constant slope incline zone and a pair of transition zones respectively interconnecting each landing zone with said incline zone, said means for moving being operable to move each of said steps vertically in each transition zone in a manner which does not impart horizontal acceleration to said steps while maintaining the intermeshing cleat relationship of each successive pair of steps, and said means for moving comprising lateral inner and outer step chains connected to lateral inner and outer ends of said step axles, and means for kinking said inner and outer step chains in said landing zones and straightening said inner and outer step chains in said constant slope incline zone.

2. The escalator of claim 1 wherein said path of travel is curvilinear as viewed in plan.

3. The escalator of claim 2 wherein said steps each have curved lateral inner and outer edges, when viewed in plan, which are defined by first and second constant length radii derived from a common fixed center point.

4. The escalator of claim 3 wherein said means for moving is operable to maintain a constant distance between adjacent step axles as measured in a horizontal plane throughout the entirety of said path of travel.

5. The escalator of claim 1 wherein said step chains include successive links connected to said step axles and to each other at pivot joints intermediate said step axles.

6. The escalator of claim 5 wherein said step axles carry inner and outer step axle rollers which travel along inner and outer step axle tracks, and said pivot joints carry cam rollers which move along inner and outer cam tracks, said inner and outer step axle tracks and said inner and outer cam tracks respectively being vertically offset from each other in said landing and transition zones, whereby said chains are kinked in said landing and transition zones and said inner and outer step axle and cam tracks being substantially coplanar to said constant slope incline zone whereby said chains are substantially straightened in said incline zone.

7. The escalator of claim 6 wherein said outer cam tracks and said outer step axle tracks are vertically offset in said transition zones by a distance $H_\delta$ which is defined by the equation:

$$H_\delta = \sqrt{d^2 - \left(\frac{B}{2\cos\delta}\right)^2}$$

wherein:

d equals the distance between the axes of one of said outer cam rollers and an adjacent outer step roller;

B equals the arc length of the outer edge of a step; and $\delta$ equals the varying angle of incline of said outer step track at any point along one of said transition zones; and wherein said inner cam tracks and said inner step tracks are vertically offset in said transition zones a distance $H'\delta$ which is defined by the equation:

$$H'_\delta = \sqrt{d'^2 - \left(\frac{A}{2\cos\delta'}\right)^2}$$

wherein:

d' equals the distance between the axes of one of said inner cam rollers and an adjacent inner step roller;

A equals the arc length of the inner edge of a step; and $\delta'$ equals the varying angle of incline of said inner step track at any point along one of said transition zones.

* * * * *

UNITED STATES PATENT AND TRADEMARK OFFICE

CERTIFICATE OF CORRECTION

PATENT NO. : 4,949,832

DATED : August 21, 1990

INVENTOR(S) : Frank M. Sansevero

It is certified that error appears in the above-identified patent and that said Letters Patent is hereby corrected as shown below:

Col. 4, line 60 "$H_{67}$ and $H'_{67}$" should read --$H_{\delta}$ and $H'_{\delta}$-- .

Signed and Sealed this

Twenty-eighth Day of January, 1992

*Attest:*

HARRY F. MANBECK, JR.

*Attesting Officer*

*Commissioner of Patents and Trademarks*